US008356739B2

(12) United States Patent
Huang

(10) Patent No.: US 8,356,739 B2
(45) Date of Patent: Jan. 22, 2013

(54) STAPLER

(76) Inventor: Chien Chuan Huang, Chang Hua (TW)

( * ) Notice: Subject to any disclaimer, the term of this patent is extended or adjusted under 35 U.S.C. 154(b) by 253 days.

(21) Appl. No.: 12/909,110

(22) Filed: Oct. 21, 2010

(65) Prior Publication Data

US 2012/0097728 A1 Apr. 26, 2012

(51) Int. Cl.
*B25C 5/00* (2006.01)

(52) U.S. Cl. ..... 227/120; 227/107; 227/132; 227/134

(58) Field of Classification Search ..... 227/120, 227/107, 1, 32, 134
See application file for complete search history.

(56) References Cited

U.S. PATENT DOCUMENTS

| | | | | |
|---|---|---|---|---|
| 5,988,478 | A * | 11/1999 | Marks | 227/132 |
| 7,963,429 | B2 * | 6/2011 | Zolentroff | 227/120 |
| 2006/0213948 | A1 * | 9/2006 | Marks | 227/134 |
| 2009/0289095 | A1 * | 11/2009 | Huang | 227/120 |
| 2011/0030525 | A1 * | 2/2011 | Huang | 83/620 |

* cited by examiner

*Primary Examiner* — Brian D Nash
(74) *Attorney, Agent, or Firm* — Bacon & Thomas, PLLC

(57) ABSTRACT

A stapler includes a main arm having two slots and two pivots, wherein two links have two respective first ends thereof are movably and pivotably connected to the two slots, and two respective second ends of the links are pivotably connected to the two pivots of the main arm. An operation arm having a strike plate is pivotably connected to a base and a magazine is located between the operation arm and the base. By pivoting the main arm downward, the two links are movable in the two slots and drive the operation arm to lower the strike plate to eject the staples in the magazine.

7 Claims, 8 Drawing Sheets

STAPLER

FIELD OF THE INVENTION

The present invention relates to a stapler, and more particularly, to a stapler requiring less force to operate.

BACKGROUND OF THE INVENTION

A conventional stapler is shown in FIG. 8 and generally includes an operation arm 65 and a magazine 67, and both of which are pivotably connected to the rear end of the base 68 by a first pivot 66. A main arm 61 is pivotably connected the front end of the base 68 by a second pivot 62. The main arm 61 is mounted onto the operation arm 65, and the pin 64 is pivotably connected to the operation arm 65 and movable within the slots 63 in the main arm 61. When a force is applied at the point "P" on the main arm 61, the main arm 61 is pivoted about the second pivot 62 and the distance from the point "P" to the second pivot 62 is the first force arm "A". The insides of the slots 63 apply a force to the pin 64 when pivoting the main arm 61, so that the operation arm 65 is pivoted toward the magazine 67. The distance from the second pivot 62 to the pin 64 is the second force arm "B". For the operation arm 65, the pin 64 applies a force about the first pivot 66 and the distance from the pin 64 to the first pivot 66 is the third force arm "C". Therefore, the operation arm 65 is pivoted about the first pivot 66 to allow the strike plate 651 on the operation arm 65 to eject one of the staples in the magazine 67. The distance from the strike plate 651 to the first pivot 66 is the fourth force arm "D". When the first force arm "A" is longer than the second force arm "B", although the third force arm "C" is shorter than the fourth force arm "D", the ratio "A" to "B" is way larger than the ratio "C" to "D". Therefore, the force of striking the staples can be properly increased to save the force required from the users.

Nevertheless, when the user pivots the main arm 61 downward, the force moves the pin 64 downward so that the transmission ratio A/B of the force from the main arm 61 is larger than the transmission ratio C/D of the force from the operation arm 65 to complete the stapling process. The pin 64 of the operation arm 65 is located within the slots 63 in the main arm 61, and the frequent movement of the pin 64 causes wearing between the pin 64 and the slots 63 so that when pivoting the main arm 61, a small amount of pivotal distance of the main arm 61 does not drive the operation arm 65. This affects the quality and efficiency of the stapling process.

The present invention intends to provide a stapler which improves the shortcomings of the conventional staplers.

SUMMARY OF THE INVENTION

The present invention relates to a stapler and comprises a main arm having two slots defined through two sidewalls thereof, two first pivot holes defined through the two sidewalls and located at a first end of the main arm, and two first pivots extending from the two sidewalls and located beside the first pivot holes. Two links each have a top hole and a bottom hole. A pin extends through the slots of the main arm and the top holes of the two links. The first pivots of the main arm are pivotably engaged with the bottom holes of the two links. An operation arm has two mediate holes and two rear holes, wherein the two mediate holes are defined through mediate portions of two sidewalls of the operation arm and the rear holes are defined through a first end of the two sidewalls of the operation arm. A base has two first connection holes, two second pivots and a magazine which is located in the base. The first connection holes are defined through a first end of the base and the operation arm is pivotably connected to the first connection holes by the rear holes. The second pivots are pivotably connected to the first pivot holes of the main arm.

The primary object of the present invention is to provide a stapler wherein the slots of the main arm are provided for movement of the links so that when the main arm is pivoted, the links move the pin which pivots the operation arm to lower the strike plate to eject the staples. Also, the stapler of the present invention also makes the user to staple stack of paper sheets with less effort.

Another object of the present invention is to provide a stapler wherein the rollers of the main arm are movable in the grooves in the top cover so that the top cover and the main arm are smoothly pivoted when stapling.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
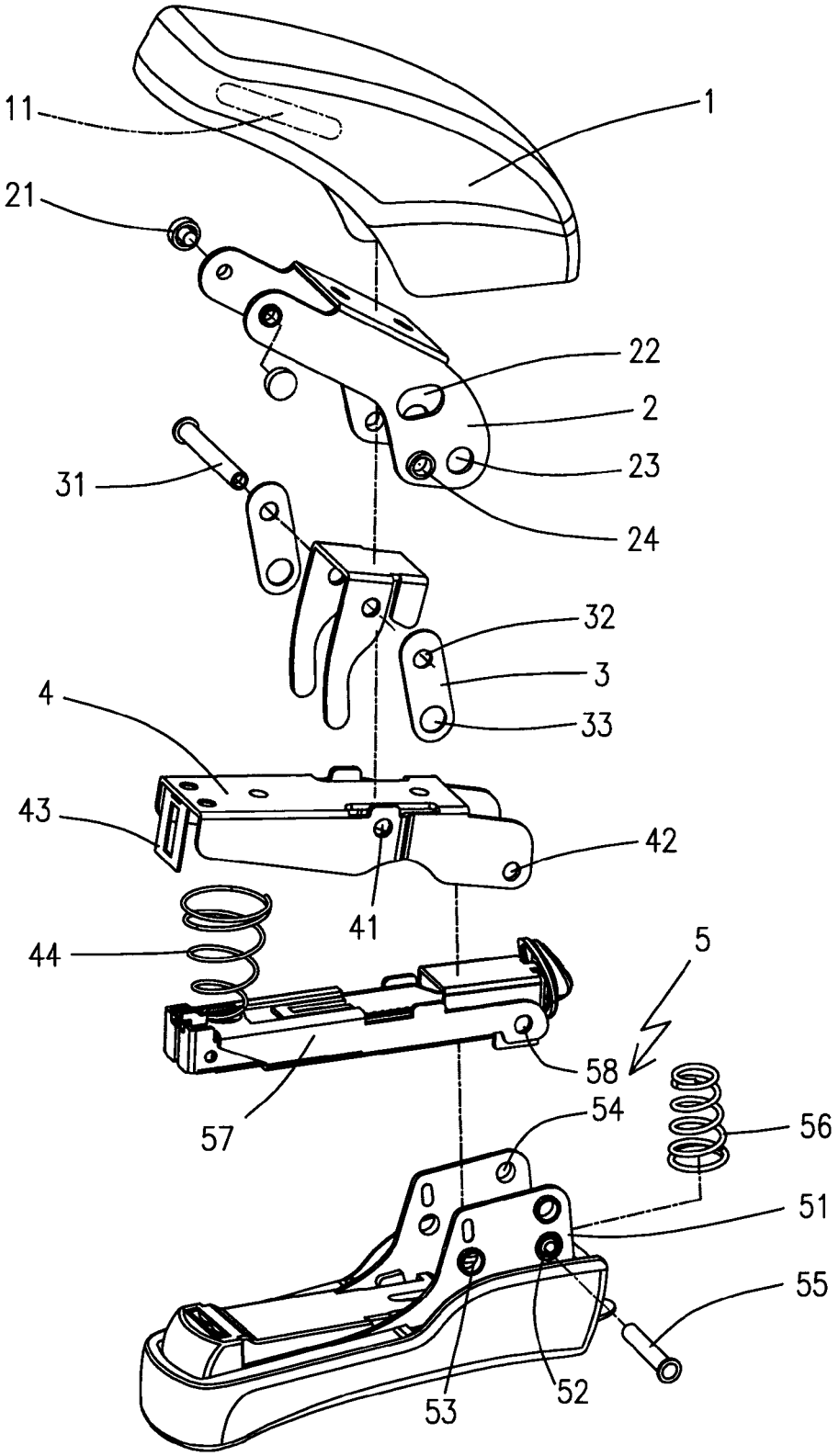
FIG. 1 is an exploded view to show the stapler of the present invention.
Figure 2:
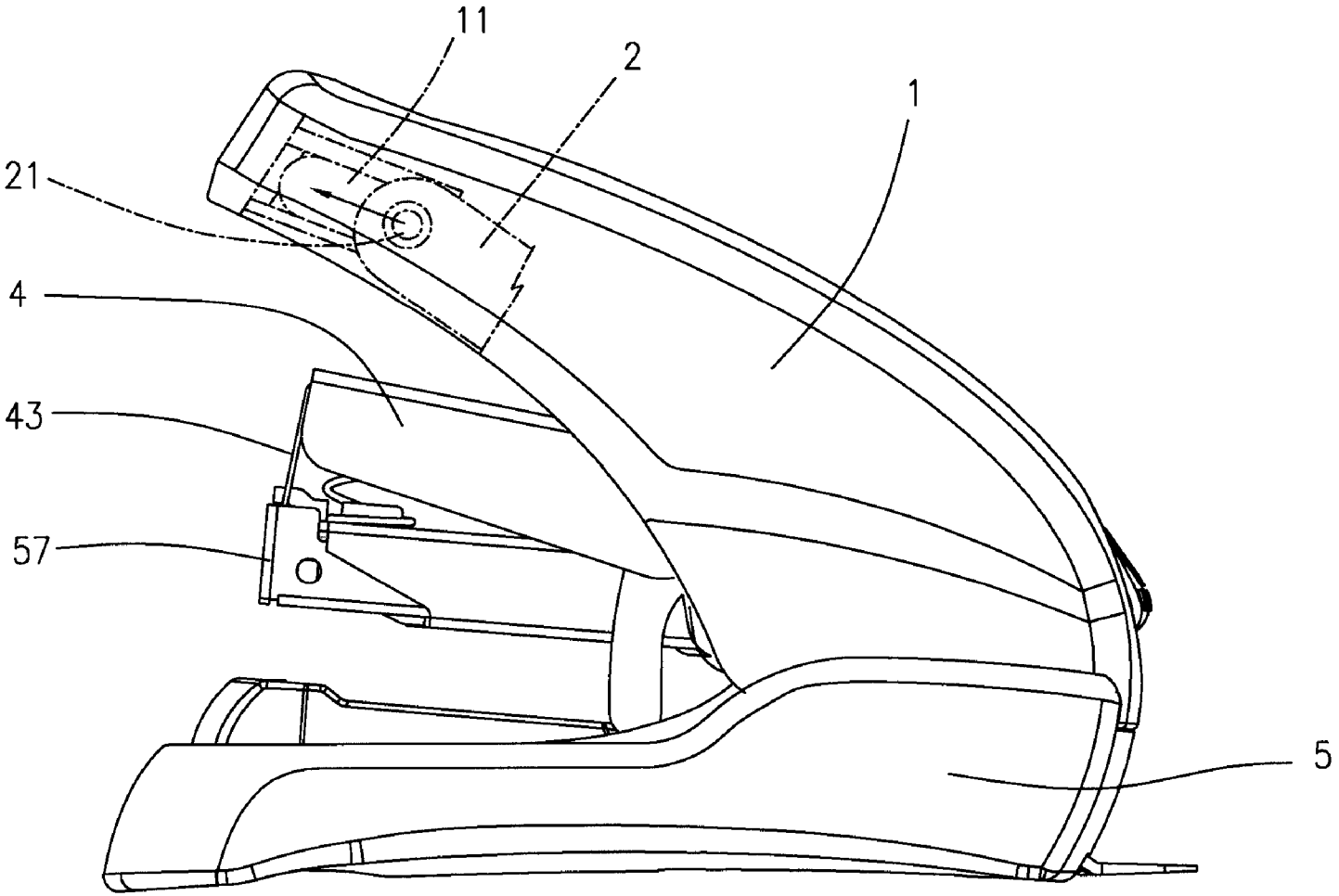
FIG. 2 is a side view of the stapler of the present invention.
Figure 3:
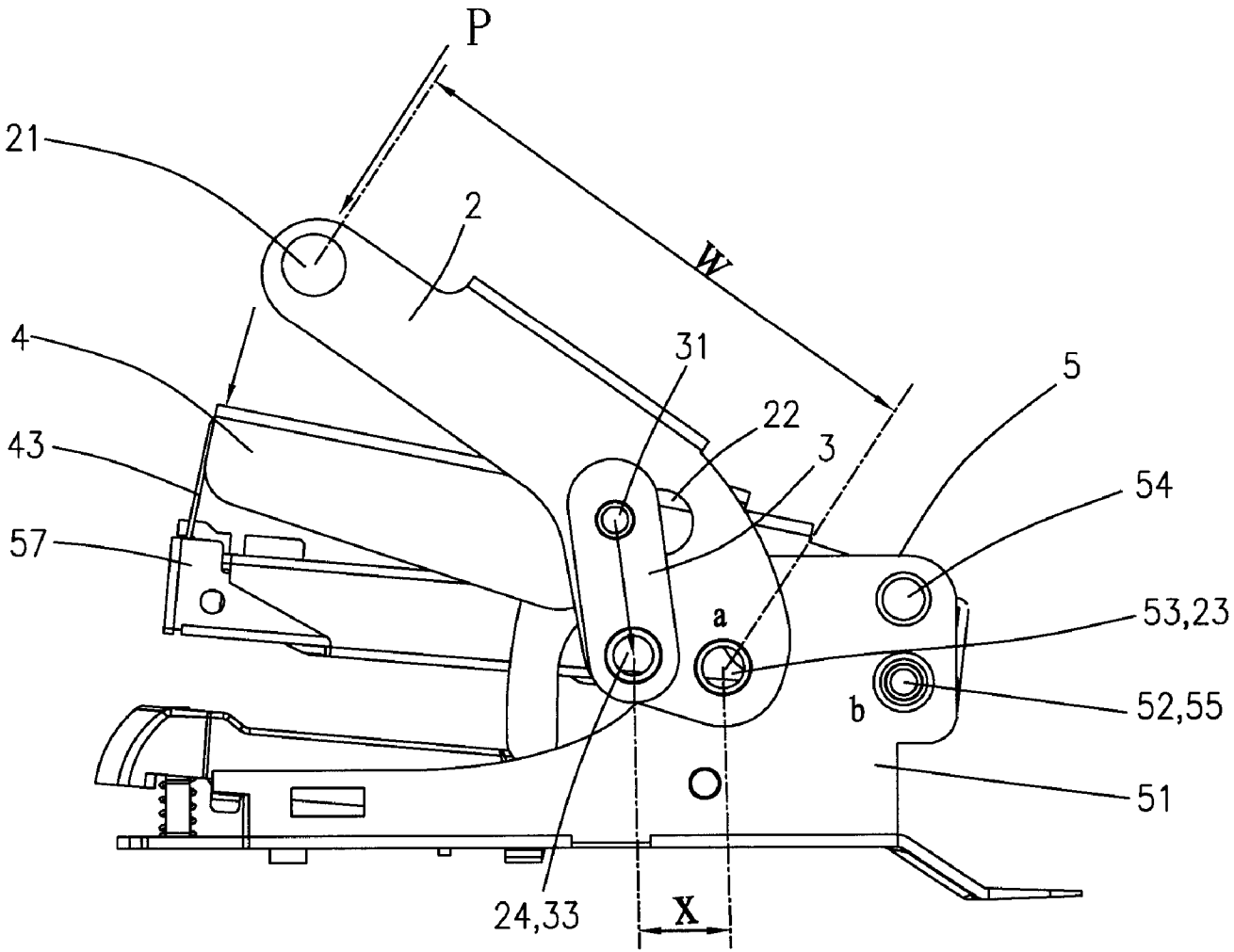
FIG. 3 shows that the main arm is not yet pivoted.

Referring to FIGS. 1 to 3, the stapler of the present invention comprises a top cover 1 which includes two grooves 11 defined in two insides thereof A main arm 2 has two slots 22 defined through two sidewalls thereof and two first pivot holes 23 are defined through the two sidewalls and located at a first end of the main arm 2. Two first pivots 24 extend from the two sidewalls and located beside the first pivot holes 23. The top cover 1 is mounted to the main arm 2. The main arm 2 has two rollers 21 which are movably connected to a second end of the main arm 2 and the rollers 21 are movably engaged with the grooves 11 of the top cover 1.

Two links 3 each have a top hole 32 and a bottom hole 33, and a pin 31 extends through the slots 22 of the main arm 2 and the top holes 32 of the two links 3. The first pivots 24 of the main arm 2 are pivotably engaged with the bottom holes 33 of the two links 3.

An operation arm 4 has two mediate holes 41 and two rear holes 42, wherein the two mediate holes 41 are defined through mediate portions of two sidewalls of the operation arm 4 and the rear holes 42 are defined through a first end of the two sidewalls of the operation arm 4. The operation arm 4 has a strike plate 43 extending from a second end of the operation arm 4. The operation arm 4 includes a first spring 44 which is biased between the operation arm 4 and a magazine 57 which is pivotably connected to a base 5.

The base 5 has two first connection holes 52, two second pivots 53 extending therefrom and the magazine 57 which is located in the base 5. The first connection holes 52 are defined through a connection frame 51 on a first end of the base 5 and the operation arm 4 is pivotably connected to the first connection holes 52 by the rear holes 42. The second pivots 53 are pivotably connected to the first pivot holes 23 of the main arm 2. The base 5 includes a pin 55 which extends through the first connection holes 52 of the base 5, the rear holes 42 of the operation arm 4 and second pivot holes 58 of a first end of the magazine 57. A second spring 56 is located between the magazine 57 and the base 5.

Figure 4:
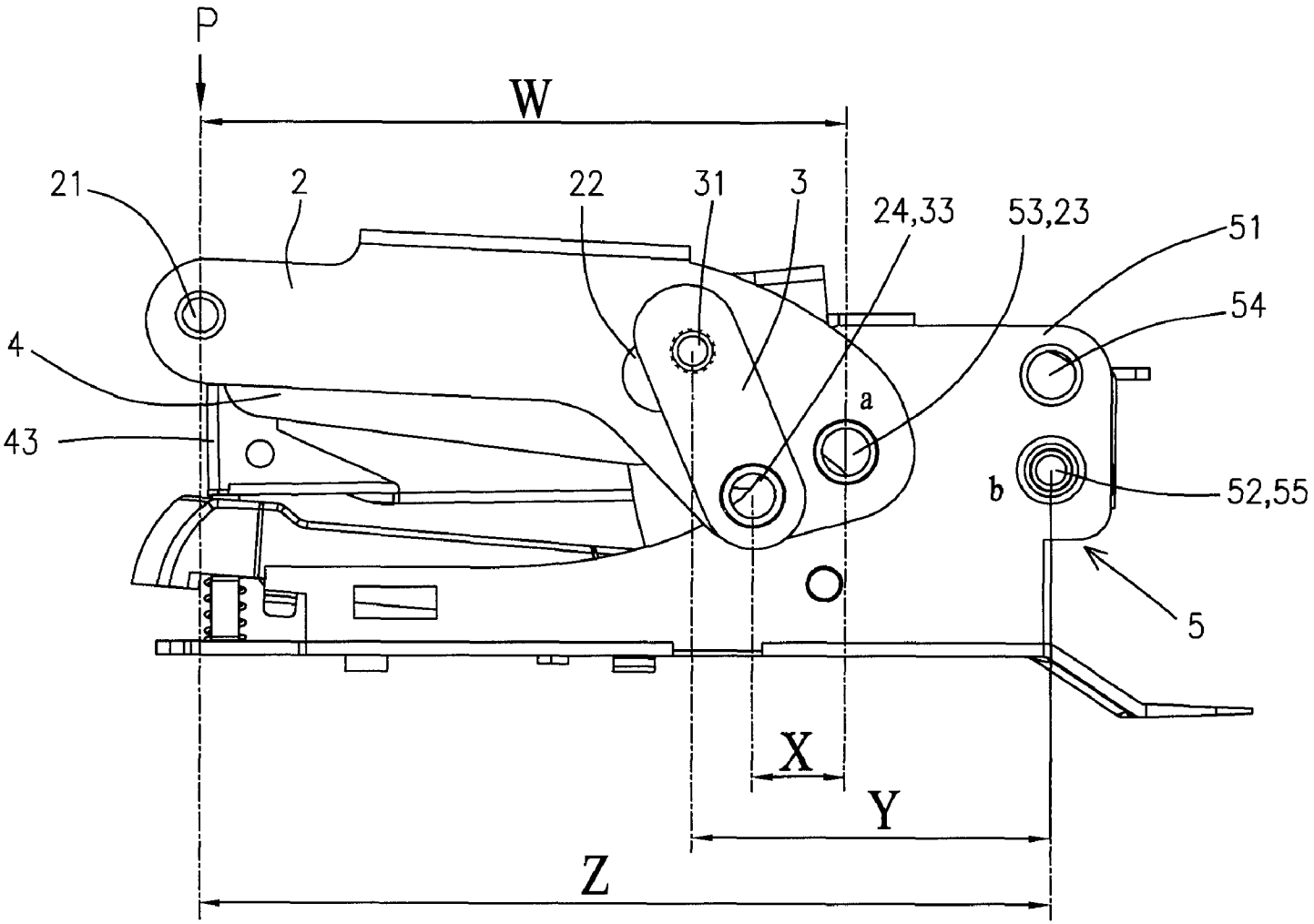
FIG. 4 shows that the main arm is pivoted downward.
Figure 5:
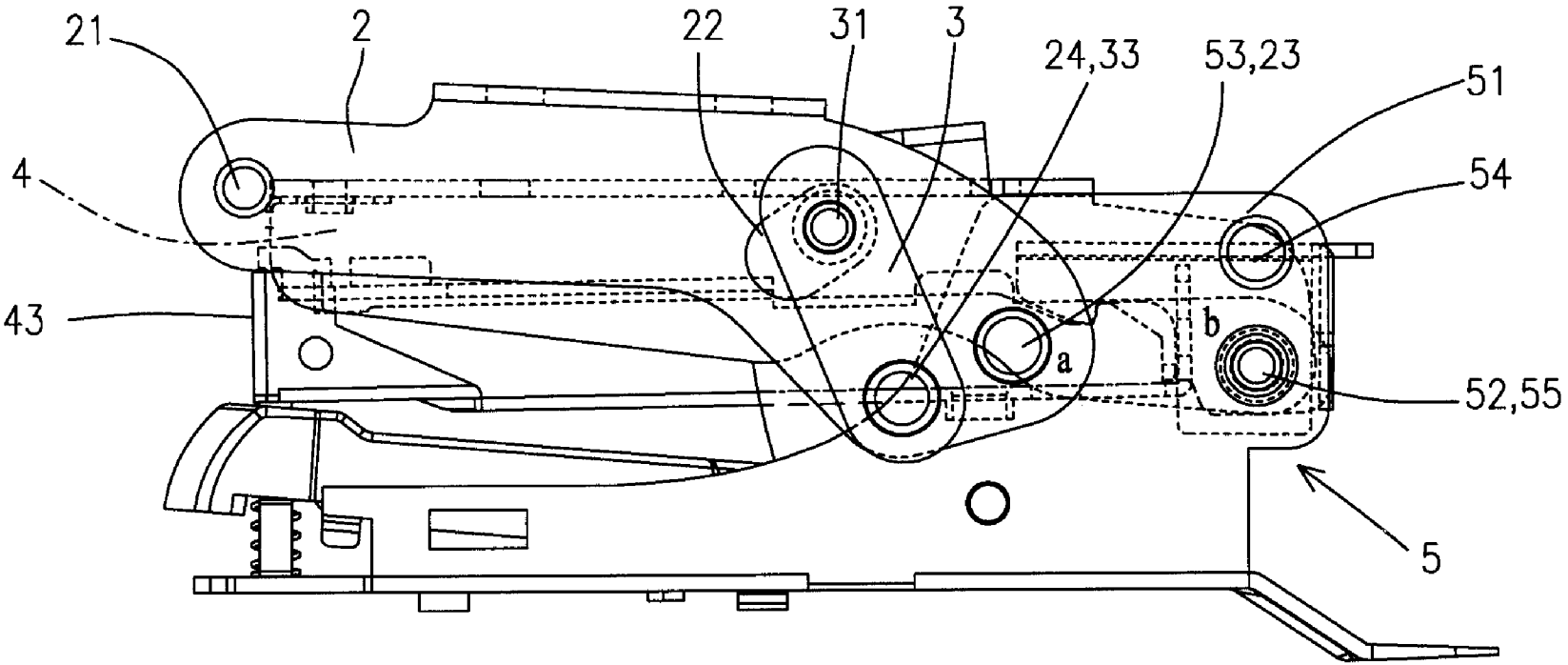
FIG. 5 is shows the relationship between the components of the stapler wherein the main arm is pivoted downward.
Figure 6:
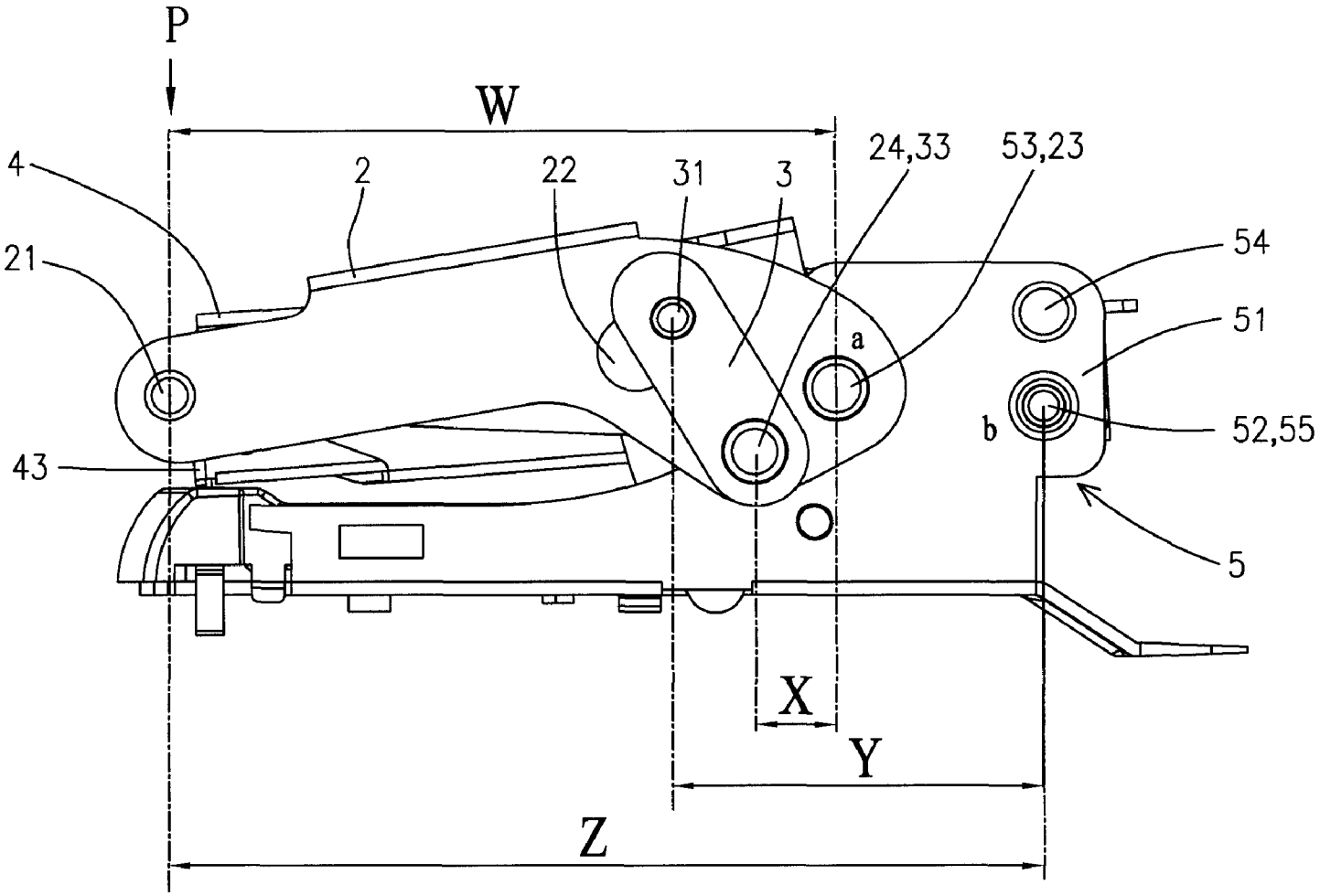
FIG. 6 shows the different force arms of the stapler when the main arm is pivoted downward.
Figure 7:
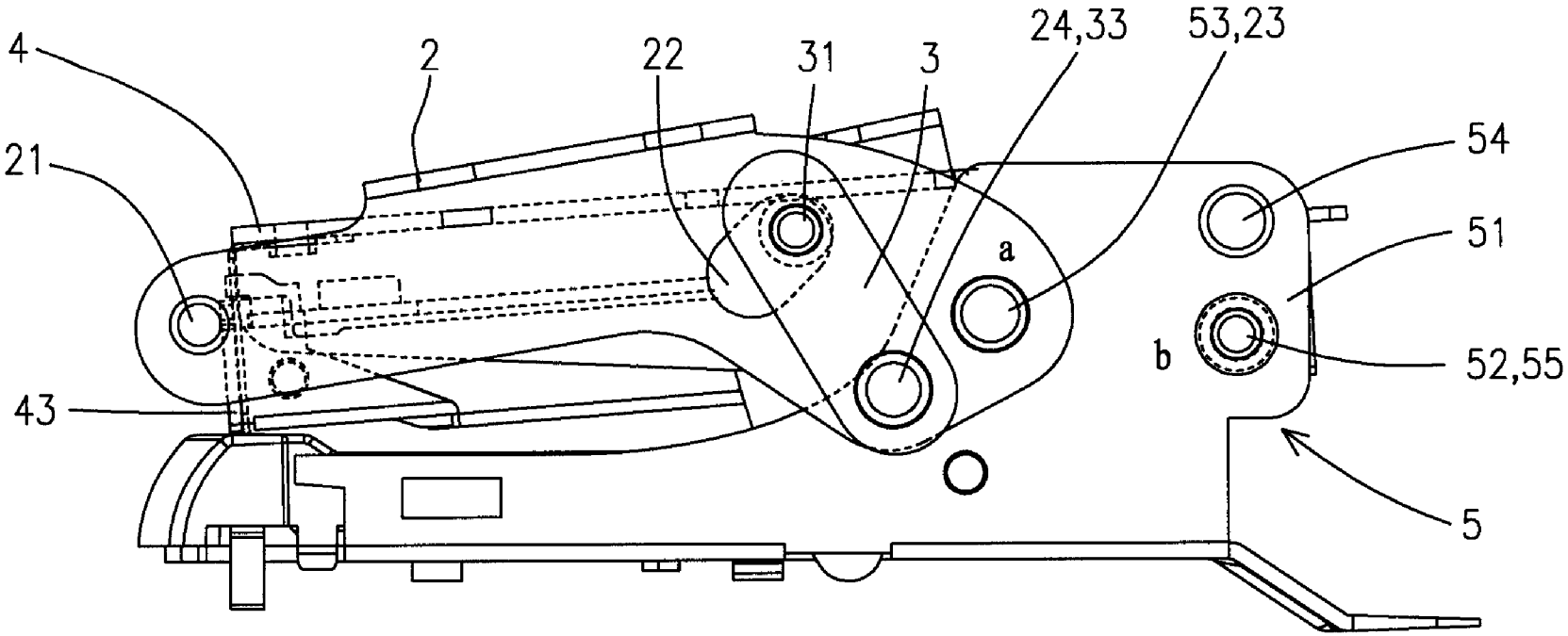
FIG. 7 shows the final position of the main arm which is pivoted downward.
Figure 8:
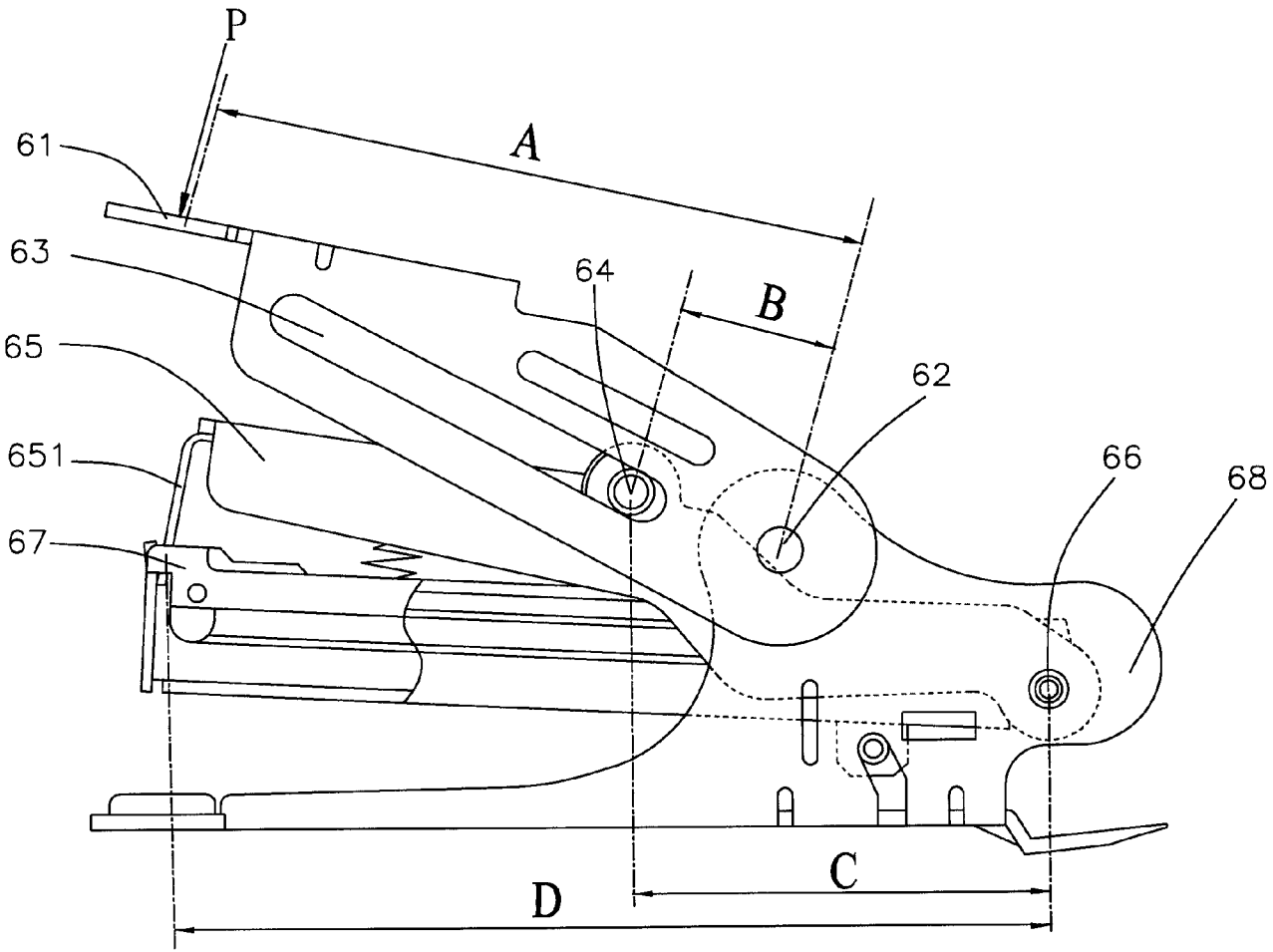
FIG. 8 PRIOR ART
FIG. 8 shows the conventional stapler.

Referring to FIGS. 3 and 4, when the user pushes the top cover 1 downward, the top cover 1 is pivoted about the second connection holes 54 and the grooves 11 move the rollers 21 of the main arm 2 to let the main arm 2 be pivoted about the point "a" at the second pivots 53 of the base 5. The distance from the force "P" is applied to the rollers 21 to the second pivots 53 is defined as the first force arm "W". The first pivots 24 of the main arm 2 pivot the links 3 downward. Because the pin 31 is pivotably connected to the mediate holes 41 of the operation arm 4, the operation arm 4 is pivoted about the pin 55 in the first connection holes 52 at the point "b". The force applied to the pin 31 is equal to the resistant force on the first pivots 24. The distance from the second pivots 53 to the first pivots 24 is defined as the second force arm "X". As shown in FIG. 5, during the action that the links 3 and the pin 31 pivot the operation arm 4, the slots 22 of the main arm 2 do not restrict the movement of the pin 31, the slots 22 only provide a space for the movement of the pin 31. For the operation arm 4, the operation arm 4 is pivoted by the links 3 and the pin 31. The operation arm 4 is pivoted about the point "b". The distance from the pin 55 to the pin 31 is defined as the third force arm "Y". The distance from the pin 55 to the strike plate 43 of the operation arm 4 is defined as the fourth force arm "Z". When the main arm 2 is continuously pivoted downward, the operation arm 4 is pivoted downward until the strike plate 43 ejects a staple in the magazine 57. As shown in FIGS. 6 and 7, the first force arm "W" is longer than the second force arm "X", the pin 31 has multiple times of the force applied to the main arm 2 so as to pivot the operation arm 4 downward. The multiple times of force drives the strike plate 43 to eject the staple. In addition, because the third force arm "Y" is shorter than the fourth force arm "Z", the force that transferred to the strike plate 43 is slightly reduced, but is still much larger than the force that applied to the main arm 2. The ratio W/X is larger than the ratio Y/Z, so that the user applies the force "P", a larger force is created at the strike plate 43 to staple the paper sheets. This result saves the force that the users need to apply to the top cover 1.

It is noted that, for the stapler of the present invention, the ratio W/X is larger than the ratio Y/Z, so that the users can use a small force to staple a stack of paper sheets.

While we have shown and described the embodiment in accordance with the present invention, it should be clear to those skilled in the art that further embodiments may be made without departing from the scope of the present invention.

What is claimed is:

1. A stapler comprising:

a main arm having two slots defined through two sidewalls thereof, two first pivot holes defined through the two sidewalls and located at a first end of the main arm, and the sidewalls including two first pivots extending therefrom and the two first pivots being located beside the first pivot holes;

two links, each link having a top hole and a bottom hole, a pin extending through the slots of the main arm and the top holes of the two links, the first pivots of the main arm being pivotably engaged with the bottom holes of the two links;

an operation arm having two sidewalls including mediate portions and a first end, two mediate holes and two rear holes, the two mediate holes defined through the mediate portions of the two sidewalls and the rear holes defined through the first end of the two sidewalls, and a base having two first connection holes, two second pivots extending therefrom and a magazine which is located in the base, the first connection holes defined through a first end of the base and the operation arm pivotably connected to the first connection holes by the rear holes of the operation arm, and the second pivots of the base being pivotably connected to the first pivot holes of the main arm.

2. The stapler as claimed in claim 1, wherein the base includes a pin which extends through the first connection holes of the base, the rear holes of the operation arm and a first end of the magazine.

3. The stapler as claimed in claim 1, wherein the main arm has two rollers which are movably connected to a second end of the main arm.

4. The stapler as claimed in claim 3, wherein a top cover is mounted to the main arm and includes two internal grooves defined therein, and the rollers of the main arm are movably engaged with the grooves.

5. The stapler as claimed in claim 1, wherein the operation arm includes a second end and has a strike plate extending from the second end.

6. The stapler as claimed in claim 1, wherein the operation arm includes a first spring which is biased between the operation arm and the magazine.

7. The stapler as claimed in claim 1, wherein the base includes a second spring which is located between the magazine and the base.

* * * * *